US007861346B2

(12) United States Patent
Wilson

(10) Patent No.: US 7,861,346 B2
(45) Date of Patent: Jan. 4, 2011

(54) CORRUGATED METAL PLATE BRIDGE WITH COMPOSITE CONCRETE STRUCTURE

(75) Inventor: Michael W. Wilson, Sackville (CA)

(73) Assignee: AIL International Inc. (CA)

( * ) Notice: Subject to any disclaimer, the term of this patent is extended or adjusted under 35 U.S.C. 154(b) by 0 days.

(21) Appl. No.: 11/173,009

(22) Filed: Jun. 30, 2005

(65) Prior Publication Data

US 2007/0000077 A1 Jan. 4, 2007

(51) Int. Cl.
*E01D 4/00* (2006.01)

(52) U.S. Cl. ..... 14/24; 14/73

(58) Field of Classification Search ..... 14/77.1, 14/73, 24

See application file for complete search history.

(56) References Cited

U.S. PATENT DOCUMENTS

| | | | | | |
|---|---|---|---|---|---|
| 501,534 | A | | 7/1893 | Palmer | |
| 1,994,829 | A | * | 3/1935 | Nagin | 52/318 |
| 2,364,395 | A | * | 12/1944 | Sims | 248/679 |
| 3,397,497 | A | | 8/1968 | Shea | |
| 3,596,421 | A | | 8/1971 | Miller | |
| 3,768,108 | A | | 10/1973 | Wadsworth | |
| 3,812,636 | A | | 5/1974 | Albrecht | |
| 4,120,065 | A | * | 10/1978 | Sivachenko et al. | 14/6 |
| 4,129,917 | A | | 12/1978 | Sivachenko | |
| 4,141,666 | A | * | 2/1979 | DeGraff | 405/126 |
| 4,211,504 | A | | 7/1980 | Sivachenko | |
| 4,271,555 | A | | 6/1981 | Mingolla | |
| 4,275,663 | A | | 6/1981 | Sivachenko | |
| 4,300,320 | A | * | 11/1981 | Rooney | 14/73 |
| 4,301,565 | A | * | 11/1981 | Weinbaum | 14/77.1 |
| 4,333,280 | A | | 6/1982 | Morton | |
| 4,563,107 | A | | 1/1986 | Peterson | |
| 4,706,319 | A | | 11/1987 | Sivachenko | |
| 4,809,474 | A | | 3/1989 | Ekberg | |
| 4,912,794 | A | | 4/1990 | Thivans | |
| 4,953,249 | A | | 9/1990 | Warwick | |
| 5,454,128 | A | * | 10/1995 | Kwon | 14/73 |
| 5,471,694 | A | | 12/1995 | Meheen | |
| 5,863,148 | A | * | 1/1999 | Shivaram | 404/28 |
| 5,940,917 | A | * | 8/1999 | Wilson et al. | 14/77.1 |
| 6,018,833 | A | | 2/2000 | Imm | |
| 6,023,806 | A | | 2/2000 | Dumlao | |
| 6,081,955 | A | * | 7/2000 | Dumlao et al. | 14/73 |
| 6,170,105 | B1 | * | 1/2001 | Doyle et al. | 14/73 |
| 6,381,793 | B2 | * | 5/2002 | Doyle et al. | 14/73 |
| 6,467,118 | B2 | | 10/2002 | Dumlao | |

(Continued)

OTHER PUBLICATIONS

International Search Report for International Application No. PCT/CA2006/001082 dated Sep. 19, 2006.

(Continued)

*Primary Examiner*—Raymond W Addie
(74) *Attorney, Agent, or Firm*—Barnes & Thornburg LLP

(57) ABSTRACT

A light to medium-duty bridge structure suitable for use in golf-courses, parks and similar settings. The bridge structure comprises at least one corrugated metal plate having corrugations oriented parallel to the longitudinal axis of the bridge structure. Applied to the upper surface of this corrugated metal plate is a layer of concrete or like material to provide a support/running surface. The corrugated metal plate is provided with a plurality of devices adapted to engage the concrete or like material so as to provide a composite corrugated metal plate-concrete structure capable of supporting light to medium-duty loads.

28 Claims, 10 Drawing Sheets

U.S. PATENT DOCUMENTS

| | | | |
|---|---|---|---|
| 6,578,343 | B1 | 6/2003 | Dumler |
| 6,595,722 | B2 | 7/2003 | McCavour |
| 2002/0020033 | A1 | 2/2002 | Lang |
| 2002/0104987 | A1 | 8/2002 | Purvis |
| 2004/0117928 | A1 | 6/2004 | Apostolopoulos |
| 2004/0216250 | A1 | 11/2004 | Dumlao |

OTHER PUBLICATIONS

Written Opinion of the International Searching Authority for International Application No. PCT/CA2006/001082 dated Oct. 24, 2006.

* cited by examiner

FIG.9b.
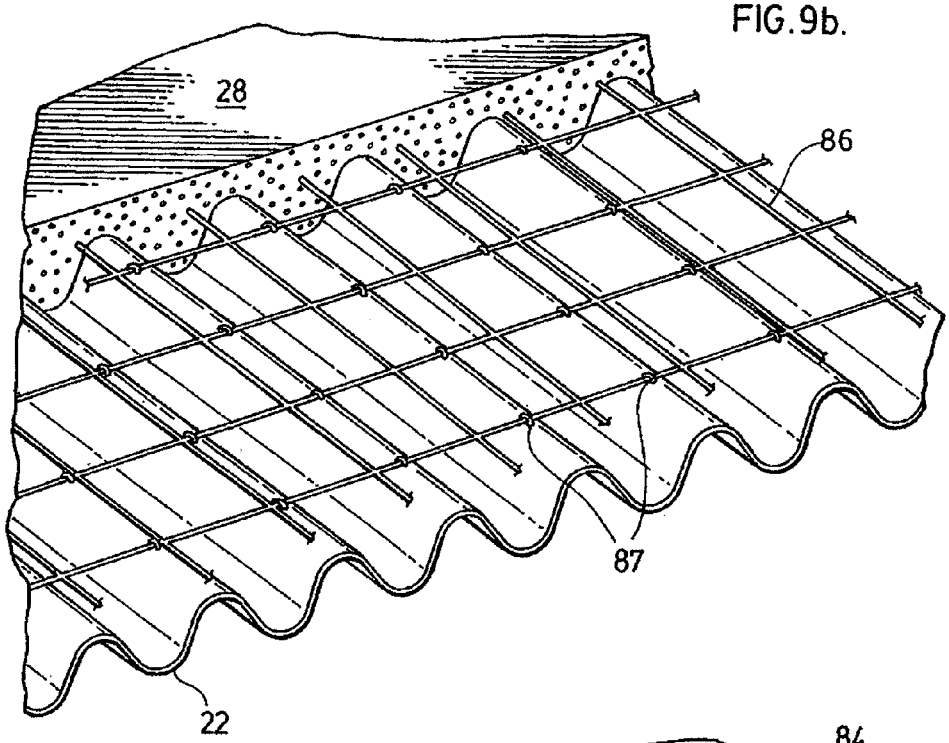
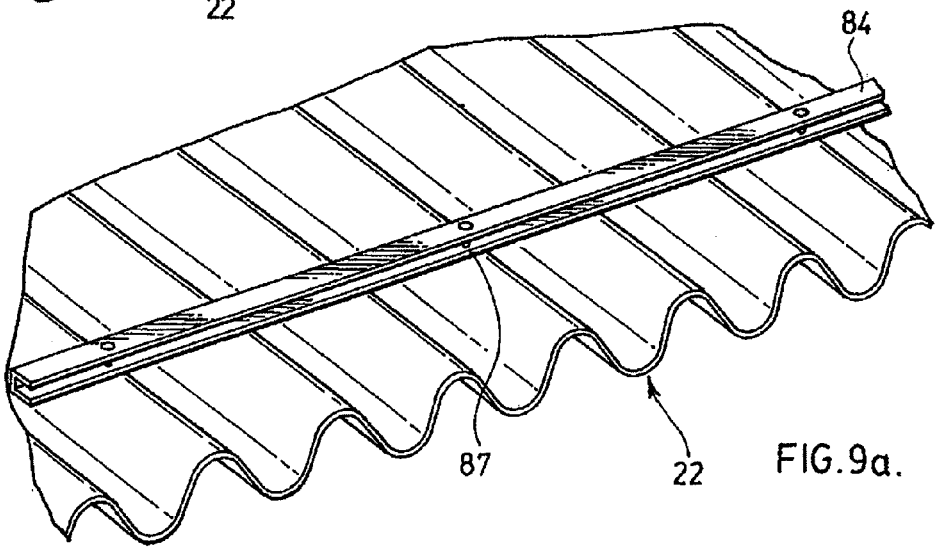
FIG.9a.

CORRUGATED METAL PLATE BRIDGE WITH COMPOSITE CONCRETE STRUCTURE

FIELD OF THE INVENTION

This invention relates to a light to medium-duty bridge comprising a composite corrugated metal plate/concrete structure.

BACKGROUND OF THE INVENTION

Golf courses, parks and other similarly landscaped environments often require bridge structures to span water courses, pedestrian walkways or other obstructions. It can be appreciated that in these environments, the use of an unsightly or cumbersome bridge structure is less than desirable. Light to medium-duty bridge structures are particularly suited for these applications.

Typically, light duty bridge structures employ structural members such as I-beams to provide the required span. The I-beams serve to support an upper support surface, which may further comprise a concrete or asphalt running surface. An example of this structure is shown in U.S. Pat. No. 501,534 to Palmer. Another lightweight bridge structure is shown in U.S. Pat. No. 3,768,108 to Wadsworth, which provides a pair of arched structural members, between which are a plurality of bracing members and a suitable load bearing surface (i.e. wood planks).

For golf courses, parks and the like, it is desirable to provide a light to medium-duty bridge structure that is easily installed, requires minimum disturbance to the surrounding environment, and can be used as a replacement bridge for aging structures. The provision of a bridge in a kit form would be particularly advantageous, as it would simplify the transport and installation process.

Over the years, corrugated metal sheets or plates have proved themselves to be a durable, economical and versatile engineering material. The use of these materials in bridge structures in known, for example as shown in U.S. Pat. Nos. 4,129,917 and 6,578,343. Corrugated metal plate is particularly suited for light to medium duty applications as it can be easily transported and installed on site, facilitating the overall installation process.

SUMMARY OF THE INVENTION

The present invention is directed to a light to medium-duty bridge structure that incorporates corrugated metal plate and a settable material (i.e. concrete and/or asphalt) in a manner that forms a composite load bearing structure suitable for spanning a water course, pedestrian walkway and the like.

According to an aspect of the invention, provided is a light to medium-duty bridge structure comprising at least one corrugated metal plate having corrugations oriented parallel to a longitudinal axis of the bridge structure, said corrugated metal plate having an upper surface upon which is applied a layer of concrete or like material to provide a support surface, said corrugated metal plate being provided with a plurality of devices adapted to engage said concrete or like material so as to provide a composite corrugated metal plate-concrete structure capable of supporting light to medium-duty loads.

BRIEF DESCRIPTION OF THE DRAWINGS

Preferred embodiments of the invention are described with respect to the drawings wherein:

FIGS. 9*a* and 9*b* are perspective views showing the use of tie-rods or a tie-mat to prevent splaying of the corrugated metal plate under load.

DETAILED DESCRIPTION OF THE PREFERRED EMBODIMENTS

In accordance with this invention, a light to medium-duty bridge structure for spanning water courses and the like of up to 50 feet (or approximately 15 m) across is provided. The bridge structure described below is particularly suited for use in golf courses, or in other similar settings requiring a light to medium-duty bridge structure. Although very well suited for new installations, the bridge structure is also suitable as a replacement bridge in existing areas. Each of the structural members that comprise the bridge structure are light-weight and easily managed, permitting easier transport of the disassembled structure to the desired location. Once assembled, the resultant bridge structure, with the integrated concrete support/running surface provides a composite bridge structure, capable of withstanding light to medium-duty loads (i.e. pedestrian traffic, golf carts, small tractors, etc).

The bridge structure is generally comprised of corrugated metal plate with the corrugations oriented parallel to the longitudinal direction of the bridge. A plurality of corrugated metal plates may be assembled side-by-side, as well as end-to-end to obtain the desired width and length, respectively. Concrete, reinforced concrete or like material is subsequently applied to the top surface of this corrugated structure, forming a primary support/running surface. Asphalt may be optionally added on top of the concrete layer to provide a wear surface. To anchor the concrete to the corrugated metal plate, shear bond connectors are provided, thus forming a composite structure capable of withstanding light to medium-duty loads. Installed, the bridge structure is set upon suitable footings in accordance with standard engineering techniques.

Figure 1:
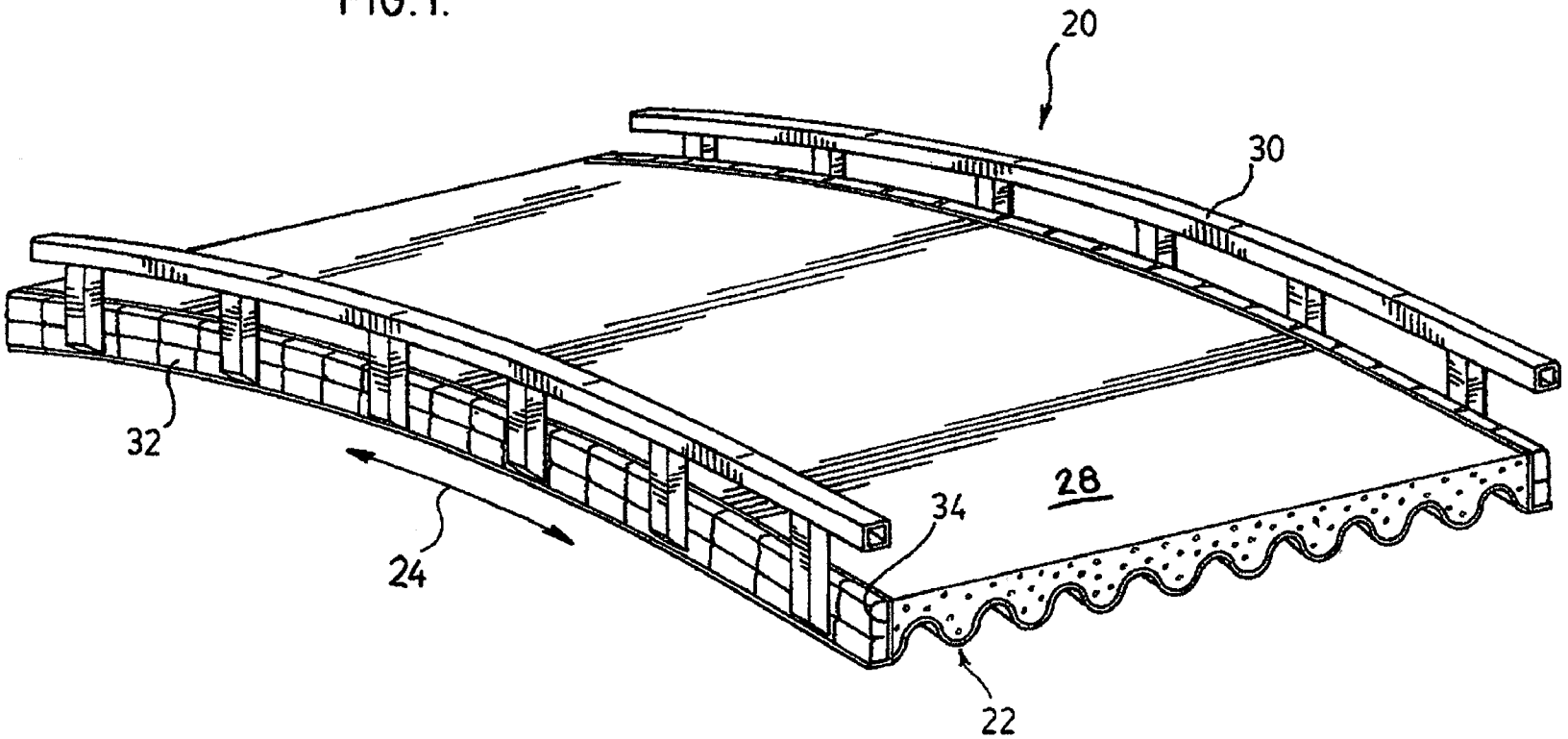
FIG. 1 is a perspective view of a first embodiment of the bridge structure.
Figure 4A:
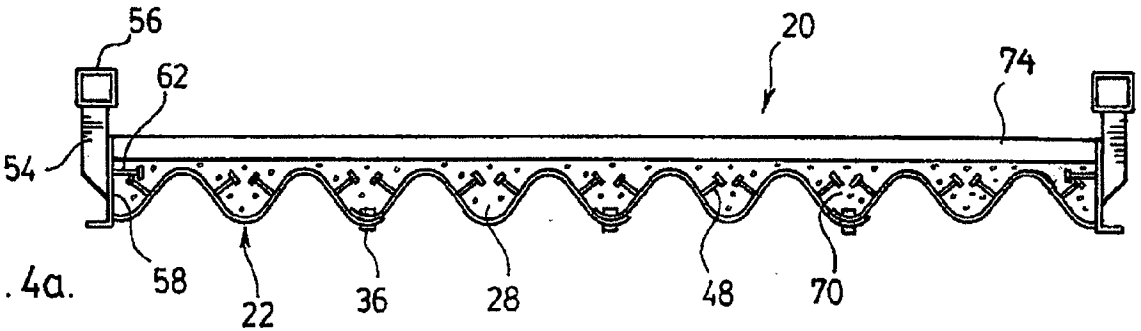
FIG. 4*a* is a cross-section of the bridge structure.
Figure 4B:
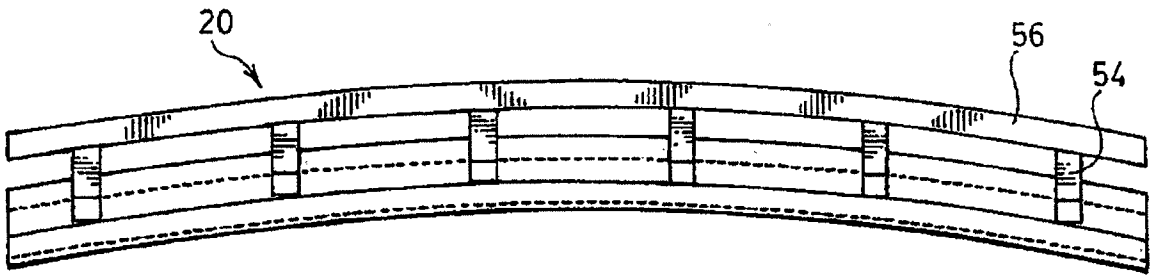
FIG. 4*b* is a side view of the bridge structure showing an arched configuration.

Turning now to FIG. 1, shown is an example of an assembled bridge structure 20 suitable for use in light to medium-duty applications. As indicated above, the bridge structure generally comprises a corrugated metal plate 22, preferably steel, of a defined thickness, and preferably galvanized with the corrugations oriented parallel to the longitudinal direction 24 of the bridge 20. The thickness of the corrugated metal plate is generally in the range of approximately 14 to approximately 3 ga. (approximately 2 mm to approximately 9 mm), with a preferred thickness of 5 ga. (5.45 mm). The corrugation depth generally ranges from approximately 2 to approximately 8 inches (51 mm to 203 mm), with a preferred corrugation depth of 5.5 inches (140 mm). The corrugation pitch generally ranges from approximately 6 to approximately 18 inches (152 mm to 457 mm), with a preferred pitch being 15 inches (381 mm). As shown, the corrugations may be smooth continuous curves with connecting tangents, but other configurations such as sinusoidal, trapezoidal, etc. are also possible. As indicated, the above dimensions are a preferred embodiment; corrugated metal plate of larger or smaller dimensions can also be used depending on the application and load requirements. It can further be appreciated that aluminum corrugated metal plate could be used, with the dimensions being adjusted (i.e. deeper corrugations) in accordance with the particular application and load requirements. Applied to the top surface of this corrugated metal plate 22, is concrete, reinforced concrete or like material so as to provide a smooth support/running surface. An additional layer of asphalt may be applied to the concrete to provide a wear surface that is durable and readily repaired/replaced as necessary. The bridge structure 20 may optionally be provided with guard rails 30 as deemed necessary for the specified application. Also note the option of decorative facing 32 on the side wall surfaces 34 of the bridge structure 20 so as to enhance the aesthetic qualities of the bridge, particularly in finely landscaped environments. It can also be appreciated that the bridge structure 20 can be either flat, or roll-formed into a shallow arch (as shown in FIGS. 1 and 4*b*) as deemed necessary for the particular application. In general, the flat configuration is suitable for light-duty applications, whereas the shallow arch is more suited for higher loads.

Figure 2:
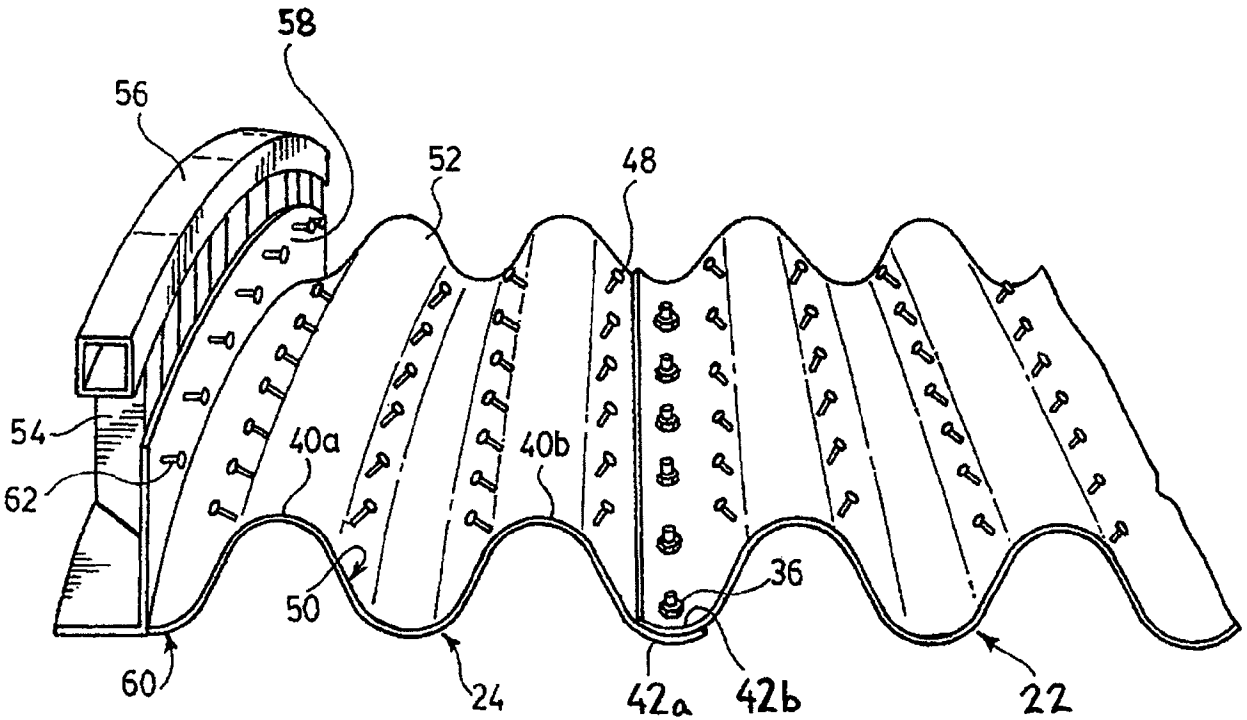
FIG. 2 is a perspective view of the bridge structure in accordance with the embodiment of FIG. 1, without the settable material in place.

As shown in FIG. 2, to achieve a particular width of bridge structure, a plurality of corrugated metal plates 22 may be arranged in side-by-side configuration. In the particular embodiment shown, each corrugated metal plate comprises two complete crests 40*a*, 40*b*, with the side-by-side corrugated metal plates 22 being interconnected in a manner to overlay adjacent trough regions 42*a*, 42*b*. To fasten the plurality of side-by-side corrugated metal plates 22 together, suitable fasteners 36 (i.e. bolts) may be used. It can be appreciated, however, that the side-by-side corrugated metal plates 22 can be welded or fused by other suitable means known in the art. It can further be appreciated that the corrugated metal plate described above comprising two crests is merely exemplary, and that configurations comprising fewer or greater numbers of crests is possible so long as the plates are configured to allow side-by-side interconnection.

Figure 3:
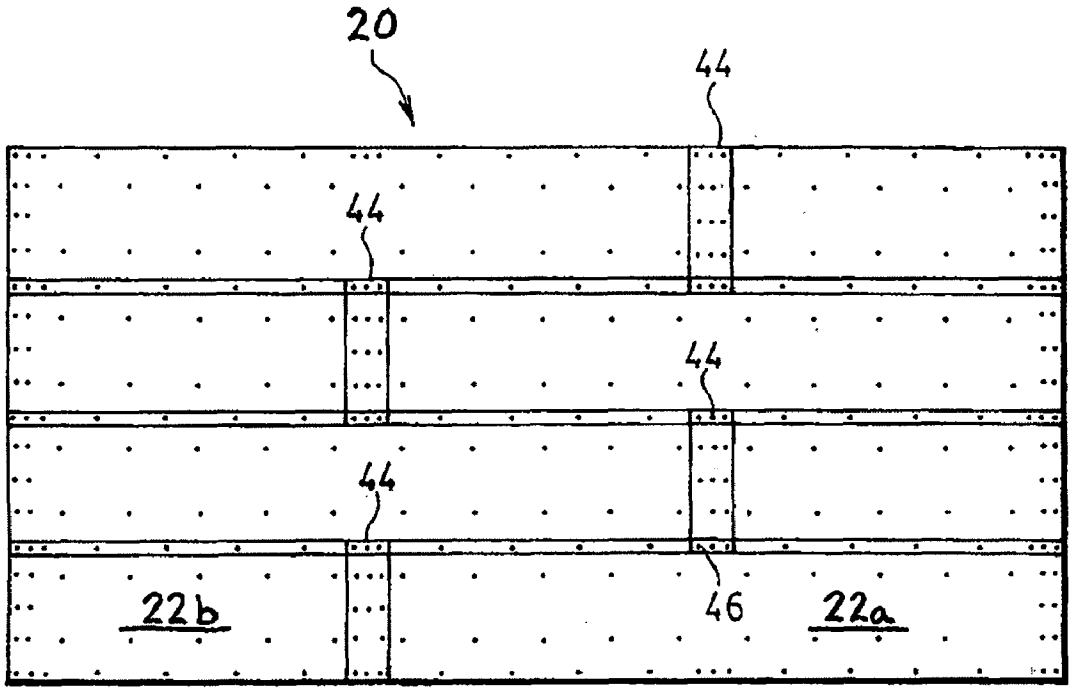
FIG. 3 is a top view of the bridge structure showing placement of multiple corrugated metal plates to establish a required width and length.

Although a single length of corrugated metal plate 22 may serve to span the entire length of bridge structure 20, it can be appreciated that multiple corrugated metal plates may be arranged end-to-end so as to achieve a desired length, especially for longer applications. In the embodiment shown in FIG. 3, the length of the bridge structure 20 is achieved by arranging end-to-end a first corrugated metal plate 22*a* and a second corrugated metal plate 22*b*, the second corrugated metal plate 22*b* having a length that is shorter than the first corrugated metal plate 22*a*. With this difference in length between the first and second corrugated metal plates 22*a*, 22*b*, in an application where multiple corrugated metal plates 22 are arranged side-by-side, a staggered configuration of corrugated metal plates is possible over the entire surface area of the bridge structure, as represented in FIG. 3. In this way, each end-to-end connection 44 is in effect strengthened by an adjacent section of uninterrupted corrugated metal plate 46. In a preferred embodiment, the second corrugated metal plate 22*b* is half the length of the first corrugated metal plate 22*a*, so as to position the end-to-end connection 44 generally central with respect to the adjacent uninterrupted corrugated metal plate 46. Similar to that described above, the end-to-end connections 44 are interconnected in a manner to overlay adjacent trough and crest regions, with the overlaps regions being fastened using suitable fasteners (i.e. bolts), or alternatively by suitable fusing means (i.e. welding) as would be apparent to one skilled in the art.

As indicated above, concrete, reinforced concrete or like material 28 is applied to the upper surface of an assembled bridge structure 20 so as to provide a smooth support/running surface. As shown in FIG. 2, to provide a shear bond between the corrugated metal plate 22 and the concrete 28, the top surface of the corrugated metal plate 22 is provided with a plurality of devices 48. In a preferred embodiment, the devices are shear studs, preferably galvanized or zinc coated, attached to the tangent regions 50 of the top surface 52 of the corrugated metal plate 22. Although the shear studs are applied to the tangent regions, alternate arrangements of the shear studs are possible. For example, the shear studs may be placed on the crests, or within the troughs of the corrugated metal plate. A combination of at least two of tangent, crest and trough mounted shear studs is also possible. To enhance the composite nature of the bridge structure, it is also possible to vary the density of the shear studs (i.e. # of studs/area of metal plate) in accordance with the intended application. For example, in certain applications, it may be advantageous to increase the density of shear studs on the corrugated metal plate towards each end of the bridge structure, thereby improving the load characteristics in these regions. In other applications, an increase in the density of shear studs in the central region of the bridge structure may be more advantageous. It can also be appreciated that the shear studs may either be integral with the corrugated metal plate 22, or secured thereto by means of suitable fasteners. Regardless of the configuration of the shear studs, in use, the metal/concrete interface acts in a composite reinforcing manner to provide a solid superstructure capable of withstanding light to medium loads placed thereon.

As can be seen in the Figures, the bridge structure 20 can optionally be provided with a guard rail as deemed necessary for the specific application. FIGS. 1, 2, 4*a* and 4*b* detail a first embodiment of a guard rail that generally comprises a plurality of generally vertical post members 54 with a continuous rail 56 aligned thereon. Specifically, as shown in FIG. 2, the plurality of generally vertical post members 54 are mounted on a rail plate 58 attached to the outermost trough region 60 of the corrugated metal plate 22. In a preferred embodiment, the rail plate 58 is welded to the outermost trough region 60 of the corrugated metal plate 22, but it can be appreciated that alternate means to attach the rail plate 58 to the outermost trough region 60 would be within the ability of one skilled in the art. To further enhance the composite reinforcing characteristics of the bridge structure 20, as well as to provide an anchor to the rail plate 58, the rail plate 58 is optionally provided with shear studs 62 or other suitable engagement means which engage the concrete or like material 28 applied to the top surface of the bridge structure 20, as shown in FIG. 4*a*. As shown, for arched bridge structures, the continuous rail 56 aligned on the generally vertical posts 54 can be suitably configured with a matching arch, as shown in FIG. 4*b*. Although not shown, the opposing outermost trough region could also be provided with a guard rail, but it can also be appreciated that certain applications could exist where only single guard rail would be necessary.

Figure 5A:
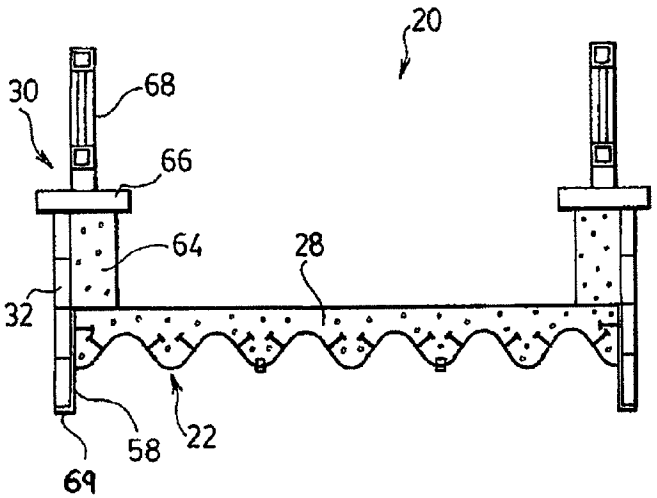
FIG. 5*a* is a cross-section of the bridge structure showing an alternate guard rail configuration.
Figure 5B:
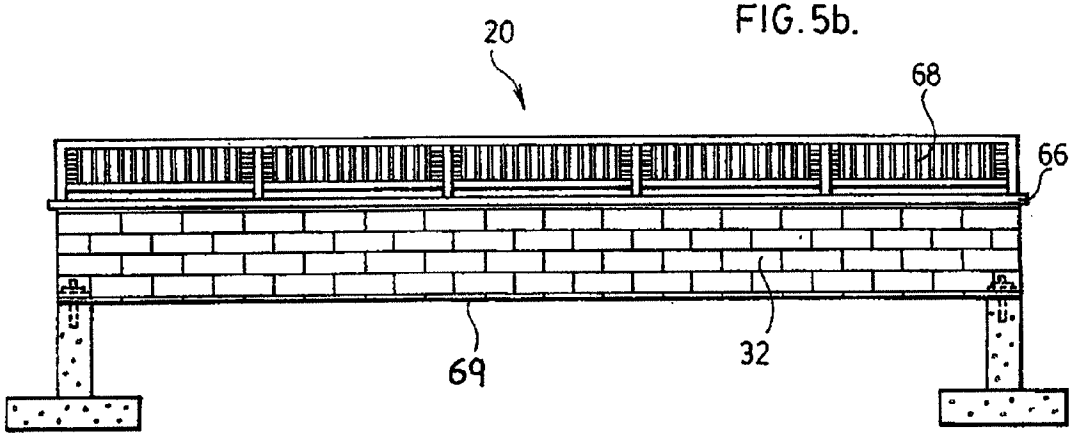
FIG. 5*b* is a side view of the alternate guard rail configuration shown in FIG. 5*a*

Alternatively, a guard rail comprising a poured concrete wall structure may be used, as shown in FIGS. 5*a* and 5*b*. In this configuration, the same generally vertical plate 58 is present, but a poured concrete wall 64 structure is provided. As shown, a cap 66 and decorative railing 68 is added to the concrete wall 64 to further enhance the aesthetic as well as the functional qualities of the guard rail 30 and bridge structure 20.

In addition to providing a safety and/or aesthetic characteristic to the bridge structure, it can be appreciated that the guard rail can also be configured to serve a structural role wherein its placement serves to increase the overall capacity of the bridge. The continuous rail 56, in concert with the vertical posts can serve as a stiffening member thereby strengthening the overall lightweight bridge structure. Other configurations of the guard rail to strengthen the overall bridge structure are also possible; these alternative designs remain within the scope of the present invention.

To enhance the overall aesthetic qualities of the bridge structure, brick, flagstone, patterned concrete or other suitable facing material 32 can be applied to the sides of the bridge structure 20, as shown in FIGS. 1 and 5*a*. To provide support to this facing material, a flange 69 on the generally vertical plate may be provided.

Figure 6:
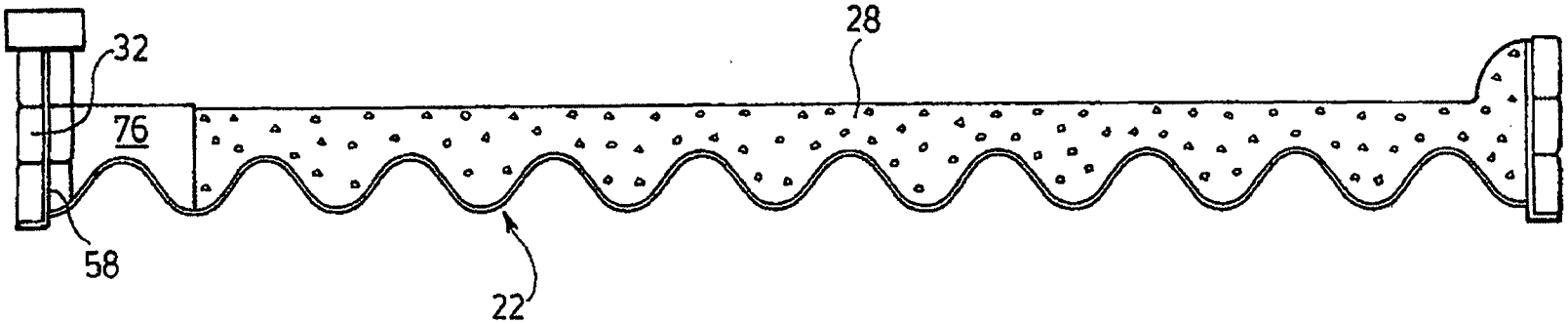
FIG. 6 is a cross-section of the bridge structure showing an alternate configuration for the settable material, in which a section of landscape is incorporated into the upper surface of the bridge structure.

As discussed above, concrete, reinforced concrete or a like material 28 is applied to the upper surface of an assembled bridge structure 20 so as to provide a smooth support/running surface. The interface between the metal and the concrete acts in a composite reinforcing manner to provide a solid superstructure capable of withstanding light to medium loads placed thereon. In the embodiment shown in FIG. 4*a*, the bridge structure 20 is provided with a first layer 70 of concrete that extends above and over the crests 72 of the corrugated metal plate 22. The bridge structure 20 is then provided with a second layer 74 of material, preferably a wear resistant material (i.e. asphalt) to provide a running or wear surface. It can be appreciated that in certain applications, a single layer of concrete or like material is sufficient, and may in certain circumstances be provided with additional thickness for enhanced structural characteristics. It can further be appreciated, that the concrete or like material may be applied in a manner that provides a decorative effect to the topside of the bridge. For example, as shown in FIG. 6, sections of concrete or like material may be absent or recessed to as to provide a 'strip' of grass, cobblestone or other suitable landscape 76. The concrete or like material may also be provided with integral box sections for placement of greenery or floral landscape. It can be appreciated that the use of concrete or like material makes it possible to incorporate a variety of integrated features that serve to enhance the overall appearance of the bridge structure.

Figure 7:
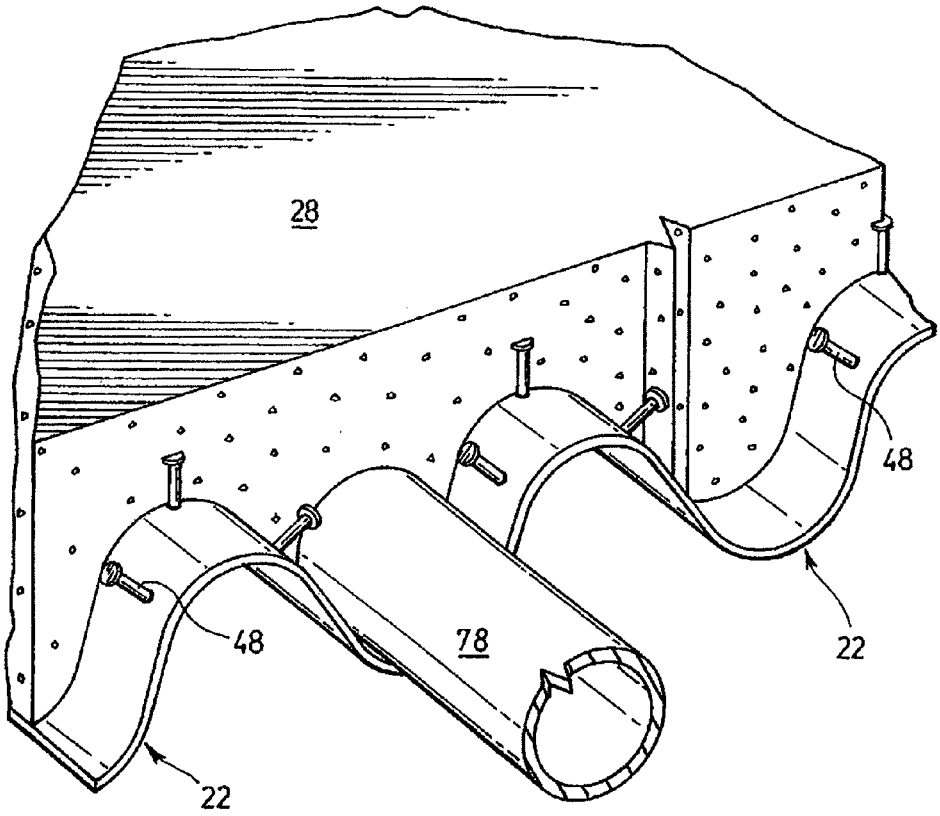
FIG. 7 is a perspective view showing an alternate embodiment of the bridge structure in which void tubes are placed in the corrugations to lighten the overall structure.

To lighten the overall bridge structure, as shown in FIG. 7, void tubes 78 can be placed in the troughs of the corrugated metal plate 22. The void tubes serve to reduce the overall amount of concrete applied to the corrugated metal plate, thereby decreasing the overall weight of the structure. The void tubes 78 can be configured to allow passage of irrigation, electrical or other utilities as deemed necessary for the particular application. The void tubes may be any suitable material, including steel, but will preferably be constructed of polyvinylchloride (PVC) or similar polymeric material. To anchor the void tubes in position, the tubes may be configured with anchoring devices which engage the concrete. For example, outside surface of the polymeric void tubes may be configured with recessed regions that receive the concrete, thereby preventing rotation and/or removal of the tube relative to the concrete once set. In the event that the void tubes are constructed of steel, it may be advantageous to provide anchoring devices (i.e. shear studs) on the top section of the outside surface of the tubes. Alternatively, it may be advantageous in certain applications to extract the void tubes once the concrete is set, thereby leaving an engineered void space in the concrete layer.

Figure 8:
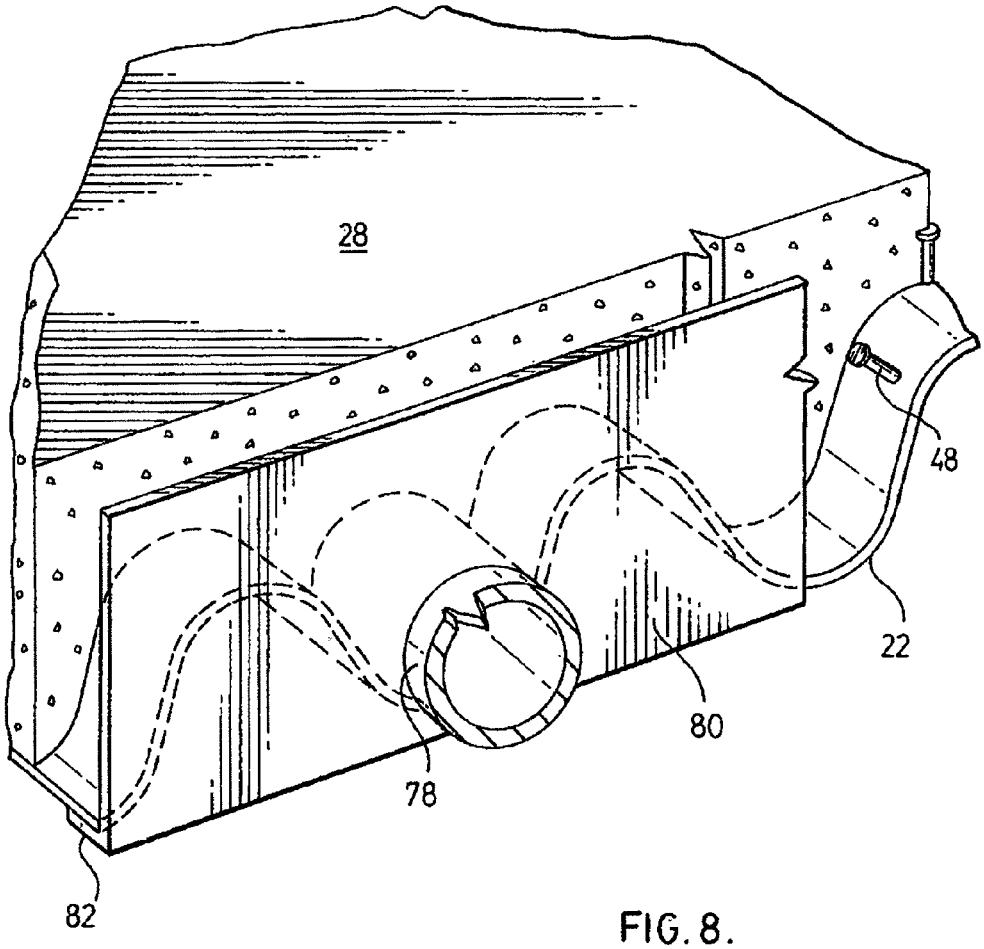
FIG. 8 is a perspective view showing an alternate embodiment of the bridge structure in which the end section of the corrugated metal plate are capped with an cap plate.

As shown in FIG. 8, the end sections of the corrugated plate may optionally be capped with a cap plate 80 to provide enhanced strength as well as to facilitate pouring of the concrete. The cap plate 80 could be attached by any suitable means (i.e. bolts), but tack welding of the cap plate 80 to the corrugated metal plate 22 is a preferred means for attachment. The cap plate 80 may optionally comprise an angle section 82 that sits adjacent the underside of the corrugated metal plate 22. In a preferred embodiment, this cap plate optionally comprises shear studs (not shown) to contribute to the overall composite nature of the structure. In the embodiment shown in FIG. 8, the cap plate 80 is dimensioned with a height that corresponds to the full thickness of concrete 28 applied to the bridge structure. It can be appreciated, however, that other heights of the cap plate are possible. For example, in certain applications, the height of the cap plate may be limited to the height of the crests of the corrugated metal plate 22. In situations where a void tube 78 or engineered void space is present, the cap plate can be configured with a corresponding hole, so as to allow passage of irrigation equipment or other utilities (i.e. electrical) from one end of the bridge structure, through the void tubes or space, and out through the other side of the bridge.

To prevent flattening or splaying of the corrugations of the corrugated metal plate under load, the bridge structure may optionally comprise tie-bars 84 (see FIG. 9*a*) or in certain applications, a tie-mat 86 as shown in FIG. 9*b* may be more advantageous. These components span the corrugations and are suitably fixed 87 (i.e. bolted, welded, riveted, pinned, etc.) to the crests thereby assisting to maintain pitch (i.e. preventing splaying) of the corrugations under load. These components may also serve as an additional shear device, thereby contributing to the overall composite nature of the bridge. In addition, the tie-bar or tie-mat serves to reinforce the concrete, thereby serving to reinforce both the primary support structure (i.e. the corrugated metal plate) and the concrete applied thereon. The tie-bar may be made of a bar of any suitable configuration (i.e. re-bar, flat, box, L-shaped, U-shaped, I-shaped, etc.). It can be appreciated that the number of bars used on any particular bridge structure will be dependent upon the load requirements, but any number of bars, from a single unit, to a plurality of bars is possible.

Figure 10A:
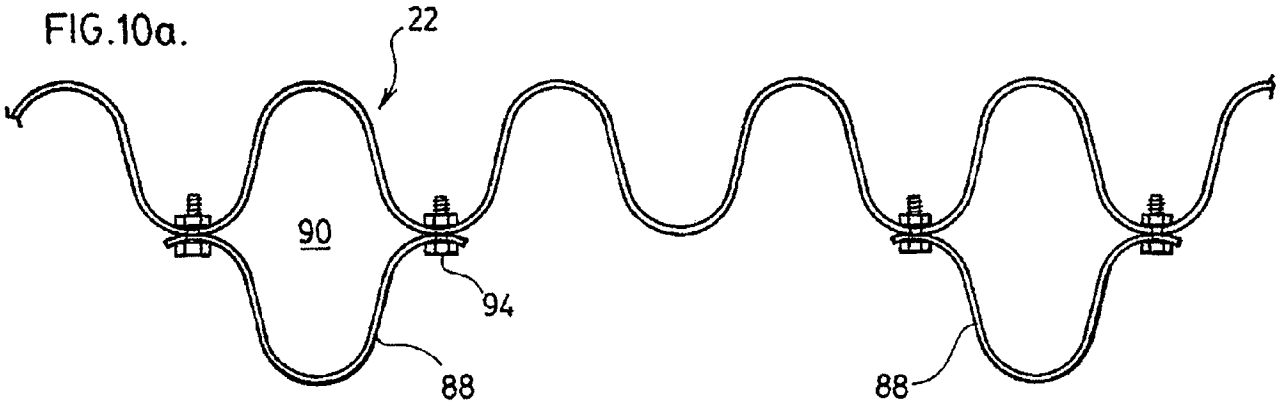
FIGS. 10*a* and 10*b* are end views showing the arrangement of a second set of corrugated metal plates serving to enhance the overall strength of the bridge structure.
Figure 10B:
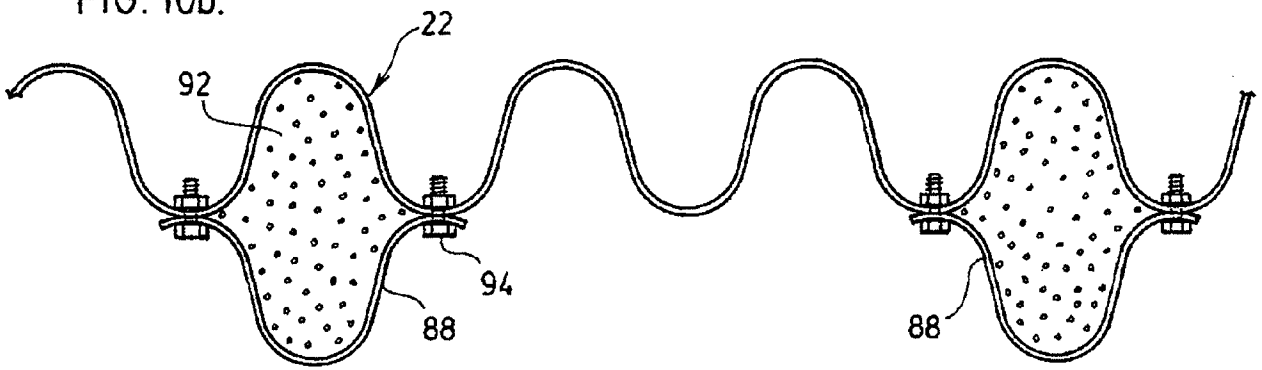

To further enhance the structural characteristics of the bridge, a second set of shaped corrugated steel plates may be interconnected in a manner to overlay the first set of plates as shown in FIGS. 10*a* and 10*b*, and as described in Applicant's U.S. Pat. No. 6,595,722, herein incorporated by reference. In the embodiment shown in the Figures, the second set of plates 88 each have a defined thickness with a pitch matching that of the first set of corrugated metal plates 22. The crests of the second set of plates 88 are suitably secured 94 (i.e. bolted, welded, riveted, etc) to the troughs of the first set of plates 22. The second set of plates 88 may comprise a single corrugation, or may comprise multiple corrugations, depending on the bridge design and load requirements. In the case of multiple corrugations, the corrugations may be either separated from each other on the underside of the first set of plates (i.e. located on every other trough of the first set of plates 22), or may be placed on adjacent troughs (i.e. side-by-side). The second set of plates 88 may extend over the effective bridge length, or just a portion thereof, as deemed necessary for supporting a load. As shown in FIG. 10*b*, the cavity 90 defined between the first and second plates may optionally be filled with concrete 92, thereby forming a concrete stiffening member.

A feature of the light to medium-duty bridge structure described above is that it can be provided in a kit form, and is suited for both new installation, as well as replacement. As a kit, the components of the bridge can be easily transported to the installation site, with minimal disturbance to the surrounding environment, and the components can be easily handled to ensure proper alignment and placement. Once in position, the concrete, reinforced concrete or like material is then added, resulting in a solid superstructure capable of withstanding light to medium loads placed thereon.

A further feature of the light to medium duty bridge structure described above is that it can be provided in both flat and arched configurations, either with or without guard rails, so as to address the particular need, whether it be safety, functionality, or aesthetics.

The invention claimed is:

1. A light to medium-duty bridge structure comprising:

a plurality of interconnected corrugated metal plates defining a base of said bridge structure, said base having a shallow arched configuration along its lengthwise dimension and having a widthwise dimension less than said lengthwise dimension, said base only being supported adjacent its opposite ends, said base further having corrugations defined by alternating crests and troughs, each of said crests and troughs extending lengthwise between the opposite ends of said base generally parallel to a central longitudinal axis of the bridge structure, said base having an upper surface;

a layer of settable concrete material applied directly to said upper surface, said layer of settable concrete material filling said troughs and extending above said crests thereby to define a support surface above said base; and a plurality of projections extending from the upper surface of said corrugated metal plates at spaced locations, said projections engaging said settable concrete material to provide a composite corrugated metal plate-concrete structure capable of supporting light to medium-duty loads.

2. The bridge structure according to claim 1 wherein said corrugated metal plates are interconnected in a side-by-side configuration.

3. The bridge structure according to claim 1 wherein said corrugated metal plates are interconnected in an end-to-end configuration.

4. The bridge structure according to claim 1 wherein said corrugated metal plates are interconnected in side-by-side and end-to-end configurations.

5. The bridge structure according to claim 1 further comprising a guard rail extending along at least one side of said bridge structure substantially from one end of said base to the other end of said base.

6. The bridge structure according to claim 4, wherein the end-to-end interconnections of said corrugated metal plates are staggered to avoid longitudinal connection seams that extend the length of said bridge structure.

7. The bridge structure according to claim 1 further comprising a layer of wear resistant material on said support surface.

8. The bridge structure according to claim 1 wherein said interconnected corrugated metal plates are roll-formed into a shallow arch to provide said base with said shallow arched configuration.

9. The bridge structure according to claim 1 wherein said interconnected corrugated metal plates are formed of galvanized steel.

10. The bridge structure according to claim 1, further comprising a tube extending along at least one trough of said base.

11. The bridge structure according to claim 1, further comprising an anti-splay device on said interconnected corrugated metal plates to maintain the pitch of said interconnected corrugated metal plates under load.

12. The bridge structure according to claim 1, further comprising an end cap positioned on at least one of the ends of said base.

13. The bridge structure according to claim 12, comprising an end cap positioned at each end of said base.

14. The bridge structure according to claim 1, further comprising at least one second corrugated metal plate secured to a bottom surface of said base, said at least one second corrugated metal plate spanning at least one pair of adjacent troughs of said base to define a cavity therebetween.

15. The bridge structure according to claim 14, wherein said cavity is filled with concrete.

16. The bridge structure according to claim 1, wherein said projections are shear studs.

17. The bridge structure according to claim 16 wherein said shear studs are located on at least one of tangents, crests and troughs of said interconnected corrugated metal plates.

18. The bridge structure according to claim 17, wherein the density of said shear studs is greater towards each end of said base.

19. The bridge structure according to claim 17, wherein said shear studs extend from tangents and crests of said interconnected corrugated metal plates.

20. The bridge structure according to claim 19, wherein the density of the shear studs extending from said interconnected corrugated metal plates varies over the length of said bridge structure.

21. The bridge structure according to claim 1, wherein each corrugated metal plate has a thickness in the range of approximately 2 mm to approximately 9 mm, a corrugation depth in the range of approximately 51 mm to approximately 203 mm, and a corrugation pitch of approximately 152 mm to 457 mm.

22. The bridge structure according to claim 1, wherein each corrugated metal plate has a thickness of approximately 5.5 mm, a corrugation depth of approximately 140 mm and a corrugation pitch of approximately 381 mm.

23. The bridge structure according to claim 5, comprising guard rails extending along opposite sides of said bridge structure substantially from one end of said base to the other end of said base.

24. The bridge structure according to claim 23, wherein each guard rail comprises a plurality of upright post members at spaced locations along said bridge structure and a generally continuous rail spanning said post members.

25. The bridge structure according to claim 23, wherein each guard rail is mounted on a rail plate secured to said bridge structure.

26. The bridge structure according to claim 25, wherein each rail plate comprises projections thereon that engage said settable concrete material.

27. The bridge structure according to claim 26, wherein the projections on each rail plate are shear studs.

28. The bridge structure according to claim 1, further comprising tubes extending along selected troughs of said base.

* * * * *